United States Patent [19]

Pine

[11] Patent Number: 5,054,850

[45] Date of Patent: Oct. 8, 1991

[54] SHIFTABLE CARRIAGE MECHANISM FOR INCLINER CHAIR

[75] Inventor: James J. Pine, Tupelo, Miss.

[73] Assignee: DBJU Inc., Verona, Miss.

[21] Appl. No.: 588,538

[22] Filed: Sep. 26, 1990

[51] Int. Cl.[5] ..... A47C 1/02; A61G 15/00

[52] U.S. Cl. ..... 297/84; 297/68; 297/88; 297/89

[58] Field of Search ..... 297/84, 85, 88, 89, 297/68, DIG. 7

[56] References Cited

U.S. PATENT DOCUMENTS 4,895,411 1/1990 Pine ..... 297/68 X

*Primary Examiner*—Peter R. Brown

*Assistant Examiner*—Milton Nelson, Jr.

*Attorney, Agent, or Firm*—Watson, Cole, Grindle & Watson

[57] ABSTRACT

Each of the left and right support assemblies for a shiftable carriage mechanism for an incliner chair includes a toggle drive subassembly that includes an upper toggle link which is pivotally connected to a mounting rail of a frame subassembly, a lower toggle link which is pivotally connected to a base member of the frame subassembly and a drive spring which is connected to the upper toggle link. The drive spring operates to position the toggle links in a locked condition when the support assembly is retracted and to drive the support assembly into an extended condition when the toggle links are manually rotated to an unlocked condition.

8 Claims, 5 Drawing Sheets

SHIFTABLE CARRIAGE MECHANISM FOR INCLINER CHAIR

BACKGROUND OF THE INVENTION

1. Field of the Invention

The present invention relates to an incliner chair, and more particularly to the carriage mechanism mounted therein which operates to move the seat, backrest, legrest and footrest when the incliner chair is converted from its upright state to its reclined state, and vice versa.

2. The Prior Art

An incliner chair, otherwise known as a "one-way" recliner chair, is a chair which employs a shiftable carriage mechanism that mounts the seat and backrest such that they will retain the same position and orientation relative to one another when the chair is converted between its upright state and its reclined state, i.e., so that the seat and backrest effectively form a unit. The frame of the chair in which the shiftable carriage mechanism is mounted remains stationary on the flooring surface on which it is positioned.

The early incliner chairs included no positive locking mechanisms or extension springs because they were weight or "gravity" operated. Later developed incliner chairs, which often contained overstuffed seats and back cushions, as well as fabrics which would not easily slide over each other, incorporated a main extension spring to help move the seat and backrest when the chair was converted to its reclined state (sometimes the occupant of the chair would not be heavy enough to cause the chair to the chair the main extension spring would be stretched to its maximum extent and apply a large force tending to convert the chair to its reclined state, thus necessitating the use of a locking mechanism to prevent inadvertent reclining of the chair. These locking mechanisms included an auxiliary spring in order to bias them into a locked condition. However, the use of both a main extension spring and an auxiliary spring for the locking mechanism results in a carriage mechanism which is complex and costly to manufacture.

In my U.S. Pat. No. 4,895,411, I have described a shiftable carriage mechanism for an incliner chair formed of left and right support assemblies which are interconnected by a torque tube and which do not utilize a main extension spring. Instead, each support assembly includes a toggle drive subassembly that includes two rotatable toggle links and a drive spring which biases the toggle links into a locked state when the support assembly is in a retracted condition (this corresponds to the shiftable carriage mechanism as a whole being in a retracted state and the incliner chair being in an upright condition), and when the toggle links are rotated to an unlocked state by an occupant in the chair, to assist the weight of an occupant in the chair to extend the support assembly (and thus the carriage mechanism as a whole) and cause the incliner chair to convert into its reclined state. I have now developed a modified version of such a shiftable carriage mechanism wherein the toggle drive subassemblies of the support assemblies provide improved action in assisting the weight of an occupant in moving the mounting rail downwardly towards the base member so that the support assemblies will extend and in causing the toggle links to rotate into a locked state as the support assemblies are retracted by the occupant in the chair.

SUMMARY OF THE INVENTION

According to the invention, the shiftable carriage mechanism utilizes interconnected right and left support assemblies which each include a frame subassembly, an extendable footrest-legrest subassembly and a toggle drive subassembly. The frame subassembly includes a base member attached to a side member of the chair frame and a mounting rail for the seat and backrest of the chair and is movably mounted above the base member. The extendable footrest-legrest subassembly is connected to the frame subassembly and is extendable or retractable based on movement of the mounting rail relative to the base member. The toggle drive subassembly, which is connected between the mounting rail and the base member of the frame subassembly, and also to a drive arm of the footrest-legrest subassembly, is capable of being in either a locked or an unlocked state. When in its locked state, the mounting rail will be fixedly positioned above the base member and the carriage mechanism will be in its retracted condition (which corresponds to the incliner chair being in its upright state). When in its unlocked state, the toggle drive assembly will operate to assist the weight of the occupant in the chair to move the mounting rail downwardly towards the base member and thereby shift the carriage mechanism into its extended condition (which corresponds to the incliner chair being in its reclined state). No main extension spring attached to and extending between the mounting rail and the base member is needed.

A further understanding of the invention will be achieved by reference to the accompanying drawings, taken in conjunction with the following discussion.

DETAILED DESCRIPTION OF THE PREFERRED EMBODIMENT

Figure 1:
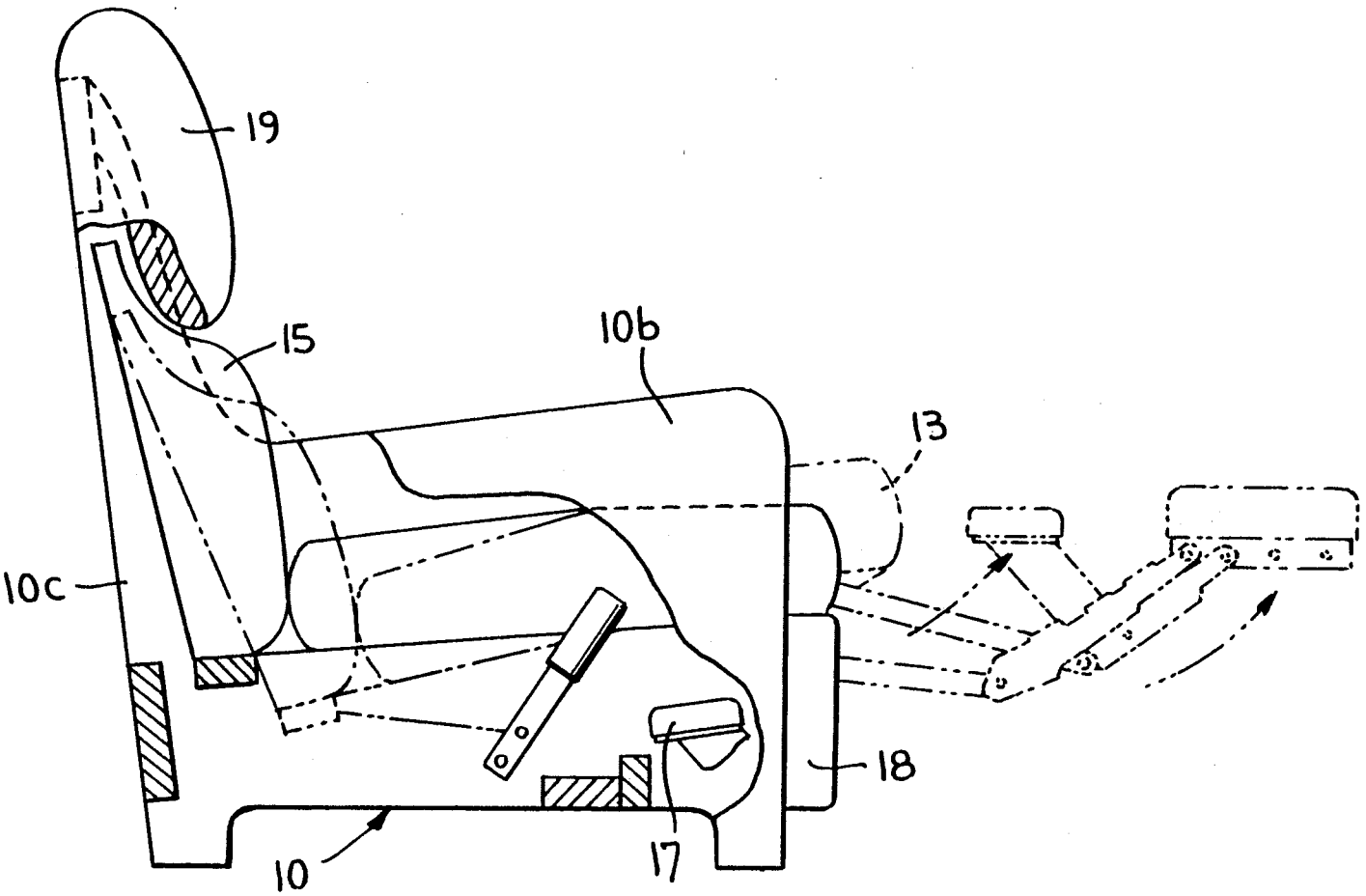
FIG. 1 is a schematic side view of an incliner chair which incorporates a shiftable carriage mechanism according to the present invention, the relative positioning of the seat, backrest, legrest and footrest when the shiftable carriage mechanism is in its retracted condition (upright state of the chair) being shown in solid lines and their relative positioning when the carriage mechanism is in its extended condition (reclined state of the chair) being shown in phantom.
Figure 2:
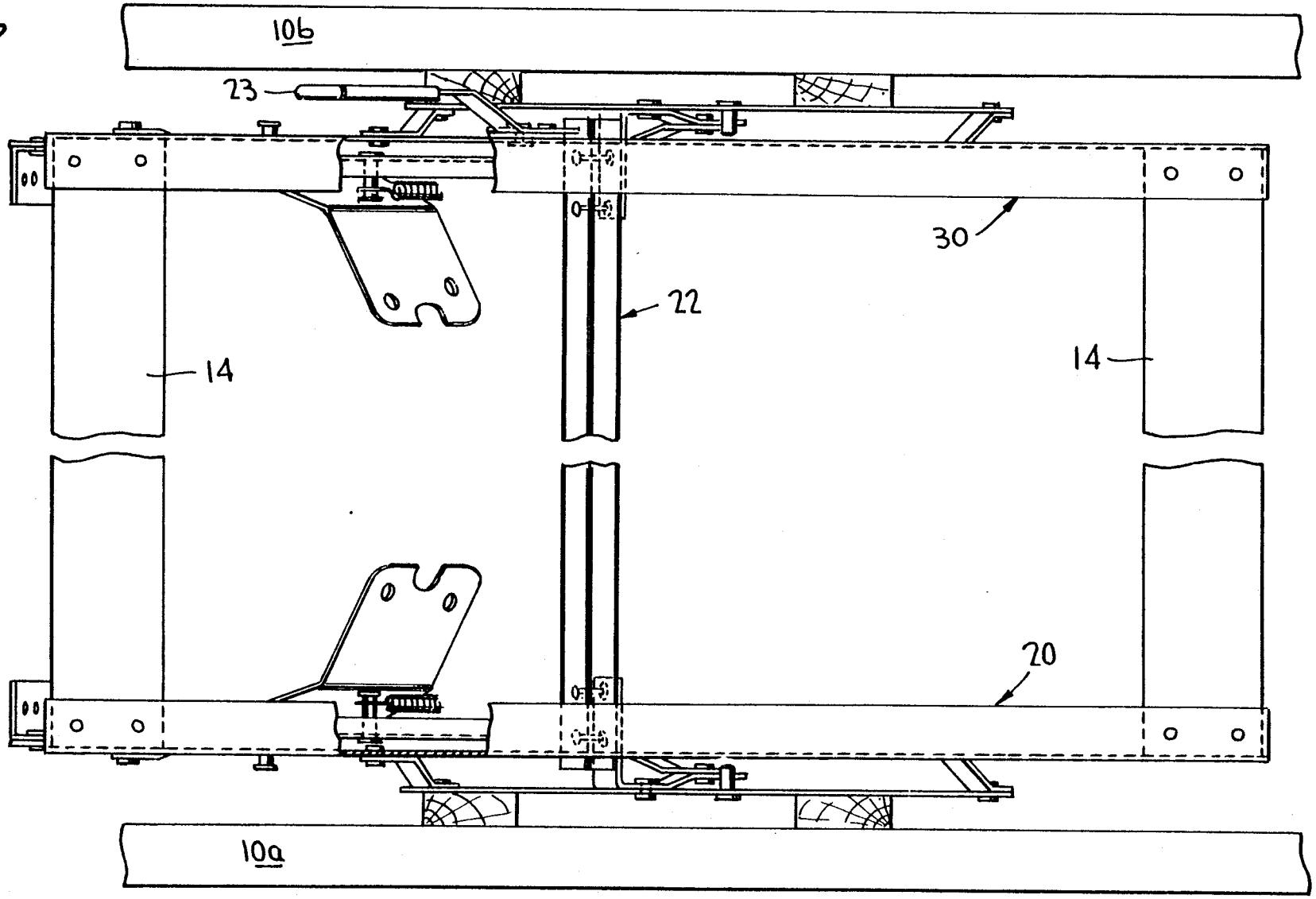
FIG. 2 is a top plan view of the shiftable carriage mechanism mounted within the incliner chair of FIG. 1 when the mechanism is in its retracted condition, the chair being depicted in reverse orientation as compared to FIG. 1.

An incliner chair which incorporates a shiftable carriage mechanism for supporting and moving the seat, backrest, legrest and footrest thereof according to the present invention is schematically shown in FIG. 1. The chair comprises a frame 10 that includes left and right side members 10*a*, 10*b* (see FIG. 2) that provide support legs along their lower edges and armrests along their upper edges, and an upwardly-extending back member 10*c*. The frame 10 is intended to remain stationary on the surface on which it is positioned regardless of whether the incliner chair is in its upright or inclined states. The incliner chair also includes a seat 13, a backrest 15, a legrest 17, a footrest 18 and a headrest cushion 19. The seat, backrest, legrest and footrest are mounted on the shiftable carriage mechanism of the invention, which in turn is mounted on the left and right side members 10*a*, 10*b* of the chair. When the shiftable carriage mechanism is in its retracted condition, which corresponds to the chair being in its upright state, the seat 13 will be generally horizontally oriented, the backrest will be generally vertically oriented, and both the legrest 17 and footrest 18 will be positioned beneath the seat 13 (see the solid line positions of these elements in FIG. 1). When the shiftable carriage mechanism is shifted to its extended condition, which corresponds to the chair being in its reclined state, the seat 13 will be inclined upwardly, its front end being located forwardly and above its prior position, the backrest 15 will be inclined rearwardly, and both the legrest 17 and footrest 18 will be positioned in front of the seat (see the phantom line positions of these elements in FIG. 1). However, the relative positioning and orientation of the seat and backrest will remain the same. The headrest cushion 19, which is attached to the top of the back member 10*c* of the frame 10, hangs down to cover the upper end of the backrest 15 irrespective of whether the chair is in its upright or reclined state.

The shiftable carriage mechanism in the incliner chair of FIG. 1 is shown in detail in FIGS. 2-5. It includes a left support assembly 20, a right support assembly 30, a torque tube 22 which is interconnected between the left and right support assemblies, and an actuating mechanism 23 which is connected to the right support assembly. The left support assembly 20 is constructed to be a mirror image of the right support assembly, such that a description of the right support assembly will suffice to describe the left support assembly. In the following description of the right support assembly 30 the terms outer and outwardly will relate to a relative location or side opposite (facing or extending away from) the left support assembly 20 and the terms inner or inwardly will relate to the location or side towards (facing or extending towards) the left support assembly 20.

Figure 3:
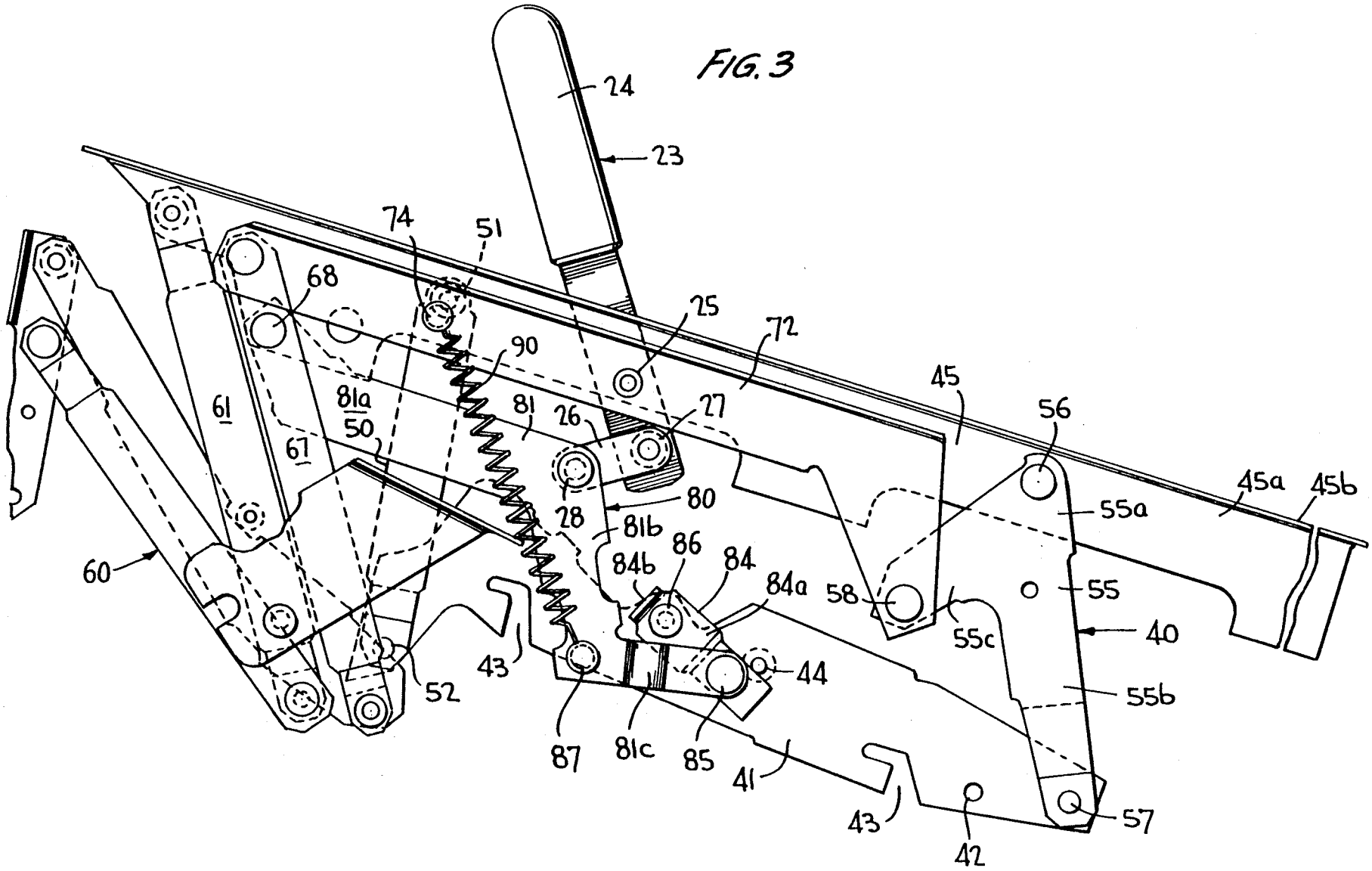
FIG. 3 is an elevational view of the right support assembly of the shiftable carriage mechanism of FIG. 2 as seen from inside the chair, the assembly being shown in its retracted condition.
Figure 4:
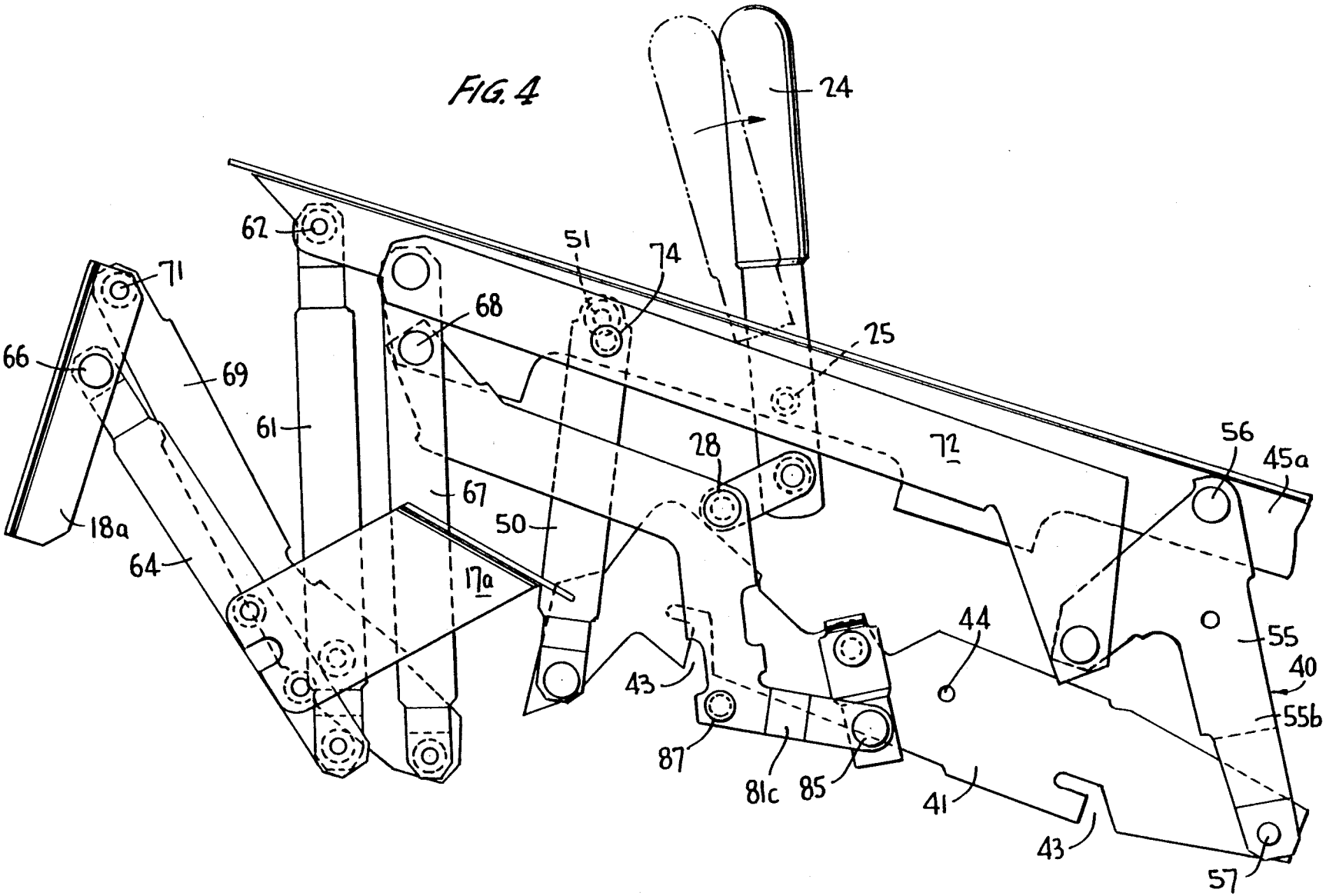
FIG. 4 is an elevational view of the right support assembly similar to FIG. 3 but wherein the assembly is shown in a partially extended condition.
Figure 5:
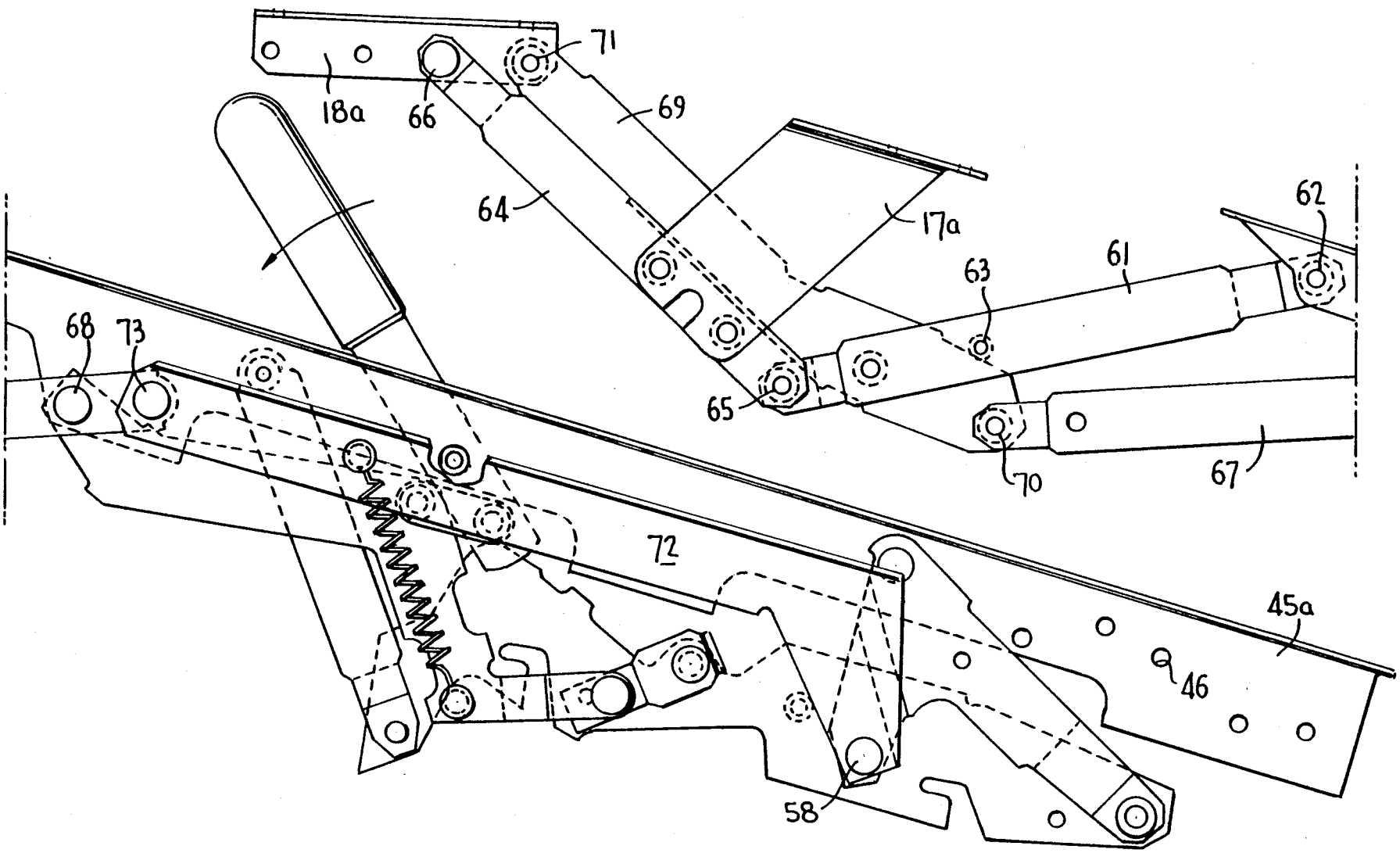
FIG. 5 is an elevational view of the right support assembly similar to FIG. 3 but wherein the assembly is shown in its fully extended condition.

As best seen in FIG. 3, the right support assembly 30 includes a frame subassembly 40, a footrest-legrest subassembly 60 and a toggle drive subassembly 80. Referring first to the frame subassembly 40, it includes an angular base member 41 which has a hole 42 near its rear end and two slots 43 along its length to enable it to be fixedly attached by suitable screws or bolts to the right side member 10*b* of the incliner chair (the corresponding base member of the left support assembly 20 is of course similarly attached to the left side member 10*a* of the chair 10). The frame subassembly also includes an elongated mounting rail 45 which is movably mounted above the base member 41 by front and rear strut members 50 and 55. The mounting rail 45 includes a vertical flange 45*a* and an inwardly-extending transverse flange 45*b*. The transverse flange 45*b* includes suitable holes near its front and rear ends (see FIG. 2) for attachment to the ends of front and rear cross beams 14 that support the seat 13. The vertical flange 45*a* includes screw holes 46 at its rear end (see FIG. 5) for connection to the bottom of the backrest 15.

The front strut member 50, which has a rectilinear configuration, has a top end which is located outwardly of the vertical flange 45*a* of the mounting rail 45 and is pivotally connected thereto by a pivot pin 51, while its lower end is located inwardly of the base member 41 and is pivotally connected thereto by a pivot pin 52. The rear strut member 55 is configured to have a head portion 55*a*, a first downwardly-extending leg portion 55*b* and a second downwardly-extending leg portion 55*c*. Its head portion 55*a* is located inwardly of the vertical flange 45*a* of the mounting rail 45 and is pivotally connected thereto by a pivot pin 56, while the lower end of its first leg portion is located inwardly of the base member 41 and is pivotally connected thereto by a pivot pin 57. The second leg portion 55*c*, which is shorter in length than the first leg portion and extends forwardly thereof, is connected by a pivot pin 58 to the rear end of a drive arm 72 of the footrest-legrest subassembly 60 (described below). The front and rear strut members are connected to the mounting rail such that, starting from the positioning shown in FIG. 3, counterclockwise rotation of these strut members about the respective pivot pins 52 and 5 will cause the mounting rail to move forwardly relative to the base member 41 and simultaneously become more inclined with its rear end moving downwardly towards the base member 41 until it reaches the positioning indicated in FIG. 5.

The footrest-legrest subassembly 60, which is of the pantograph or lazy-tong type, includes a first link arm 61 (see end of the vertical flange 45*a* of the mounting rail 45 by a pivot pin 62, a second link arm 64 whose lower end is pivotally attached by a pivot pin 65 to the first link arm and at its upper end to the footrest bracket 18*a* by a pivot pin 66, a third link arm 67 which is pivotally attached near its upper end to the vertical flange 45*a* of the mounting rail 45 by a pivot pin 68 located rearwardly of and below the pivot pin 62, and a fourth link arm 69 whose lower end is pivotally attached by a pivot pin 70 to the lower end of the third link arm 67 and whose upper end is attached to the footrest bracket 18*a* by a pivot pin 71. Its pivotal movement relative to the first link arm when extended is limited by an upper edge thereof abutting against a stop pin 63 projecting from the first link arm. A generally L-shaped legrest platform 17*a* for the legrest 17 is attached to the second link arm 64 near its lower end. The drive arm 72 is positioned inwardly of the vertical flange 45*a* and beneath the transverse flange 45*b* of the mounting rail and is connected at its rear end to the pivot pin 58 and at its front end to the upper end of the third link arm 67 by a pivot pin 73.

The toggle drive subassembly 80 is connected to the base member 41 of the frame subassembly 40, the mounting rail 45 of the frame subassembly 40 and to the drive arm 72 of the footrest-legrest subassembly 60. It comprises an upper toggle link 81, a lower toggle link 84 and a drive spring 90. The upper toggle link 81, as it extends from a forward end to a rearward end, is configured to have a first, generally horizontal leg portion 81*a* which is connected at its forward end to pivot pin 68 between vertical flange 45*a* of the mounting rail 45 and the third link arm 67, a second, downwardly inclined leg portion 81*b*, and a third, upwardly inclined leg portion 81*c*. The lower toggle link 84 includes a first leg 84*a* and a transverse second leg 84*b*. The first leg 84*a* is connected near its lower end to the rear end of the leg portion 81*c* of the upper toggle link by a pivot pin 85 and near its upper end to the base member 41 by a pivot pin 86. The transverse second leg extends inwardly of the upper end of the first leg and includes holes for attachment to the associated end of the torque tube 22. The drive spring 90 extends from a stud 87 which projects inwardly from the lower end of the second leg portion 81*b* to a stud 74 which projects inwardly from the drive arm 72 at a point towards the front end thereof. An abutment pin 44 extends inwardly from the base member 41 at a point rearwardly of the pivot pin 86 so as to contact an upper edge of the first leg 84*a* of the lower actuator link 84 and limit rotation (counterclockwise in FIG. 3) of the lower actuator link around the pivot pin 86, i.e., when the toggle drive subassembly is in its locked state (which corresponds to the right support assembly, the left support assembly and the shiftable carriage mechanism as a whole being in their retracted conditions).

The actuating mechanism 23 includes a grip lever 24 which is located outwardly of the mounting rail 45 and is pivotally connected along its length to the mounting rail by a pivot pin 25, and a connecting link 26 which is pivotally connected at one end to the lower end of the grip lever by a pivot pin 27 and at its other end to the upper end of the second portion 81*b* of the upper toggle link 81 by a pivot pin 28.

When the right support assembly 30 is in its retracted condition, the left support assembly 20 will also be in its retracted condition, and the shiftable carriage mechanism as a whole will be in its retracted condition. This condition corresponds to the incliner chair being in its upright state. The elements of the frame subassembly 40, the footrest-legrest subassembly 60 and the toggle drive subassembly 80 of the right support assembly will be positioned and oriented relative to one another as shown in FIG. 3, and the elements of the corresponding subassemblies of the left support assembly 20 will be similarly positioned and oriented.

The upward force of the drive spring 90 on the upper toggle link 81, and thus on its third leg portion 81*c*, will cause the lower toggle link 84 to rotate around the pivot pin 86 such that its upper edge will abut the abutment pin 44. The right support assembly (and also the left support assembly and the shiftable carriage mechanism as a whole) will then be in a locked state. The grip lever 24 of the actuating mechanism 23 will be forwardly oriented.

With a manual rearward pull on the grip lever 24 (clockwise rotation about pivot pin 25 in FIG. 3—see FIG. 4), the upper toggle link will move downwardly and forwardly, causing the lower toggle link to rotate around pivot pin 86 (clockwise in FIG. 3), and footrest-legrest assembly 60 to begin to extend. At a point in the rotation of the lower toggle link 84 around the pivot pin 86, the toggle drive subassembly will become unlocked (and due to the action of the torque tube 22, the toggle drive subassembly of the left support assembly will also become unlocked), and the compressive force of the spring 90, together with the weight of an occupant in the chair on the mounting rail 45, will cause the right support assembly and the left support assembly to shift into their extended conditions (FIG. 5), which corresponds to the reclined state of the incliner chair of FIG. 1. The right and left support assemblies can be retracted and the toggle drive subassemblies thereof returned to their locked states by the application of downward force on the footrest 18 by the feet of an occupant in the chair.

Although a preferred embodiment of the inventive shiftable carriage mechanism has been shown and described in detail, it is obvious that modifications therein can be made and still fall within the scope of the appended claims.

What is claimed is:

1. A support assembly for use in a shiftable carriage mechanism employed to support the seat, backrest, footrest and legrest of an incliner chair, said support assembly being itself shiftable from a retracted condition to an extended condition, and comprising a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, an extendable footrest-legrest subassembly connected to said frame subassembly for supporting the legrest and footrest of the incliner chair, said footrest-legrest subassembly including a drive arm, a toggle drive subassembly which comprises an upper toggle link having a forward end and a rearward end, said upper toggle link being pivotally connected at said forward end to the mounting rail, a lower toggle link which is pivotally connected by a first pivot pin to said base member and by a second pivot pin to said rearward end of said upper toggle link, and a drive spring which extends from said drive arm of the footrest-legrest subassembly to said upper toggle link, said upper and lower toggle links being repositionable from a locked state wherein the mounting rail is fixedly positioned above the base member to an unlocked state wherein the drive spring will cause the mounting rail to move towards the base member.

2. A support assembly according to claim 1, wherein said upper toggle link as it extends from said forward end to said rearward end comprises a first horizontal leg portion, a second, downwardly inclined leg portion, and a third, upwardly inclined leg portion, and wherein a stud is provided at a lower end of said second portion to which a lower end of said drive spring is attached.

3. A support assembly according to claim 1, wherein said base member includes an abutment pin which abuts an upper edge of said lower toggle link when said toggle drive subassembly is in a locked state.

4. A support assembly according to claim 1, wherein said footrest-legrest subassembly includes a plurality of pivotal link arms, two of said plurality of pivotal link arms being pivotally mounted to said mounting rail, and wherein said drive arm extends from one of said two pivotal link arms to said rear strut member of said frame subassembly.

5. A support assembly according to claim 1, including an actuating mechanism which is manually operable to cause said toggle drive subassembly to become unlocked.

6. A support assembly according to claim 5, wherein said actuating mechanism comprises a grip lever which is pivotally attached to said mounting rail and a connecting link which is pivotally connected at one end to said grip lever and at an opposite end to said upper toggle link.

7. A shiftable carriage mechanism for movably supporting the seat, backrest, footrest and legrest of an incliner chair, said shiftable carriage mechanism being shiftable from a retracted condition which corresponds to the incliner chair being in an upright state to an extended condition which corresponds to the incliner chair being in a reclined state, said shiftable carriage mechanism comprising:

mirror-image right and left support assemblies which each include (1) a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, (2) an extendable footrest-legrest subassembly which is connected to said frame subassembly for supporting the footrest and legrest of the incliner chair, said footrest-legrest subassembly including a drive arm, and (3) a toggle drive subassembly which comprises an upper toggle link being pivotally connected at said forward end to the mounting rail, a lower toggle link which is pivotally connected by a first pivot pin to said base member and by a second pivot pin to said rearward end of said upper toggle link, and a drive spring which extends from said drive arm of the footrest-legrest subassembly to said upper toggle link, said upper and lower toggle links being repositionable from a locked state wherein the mounting rail is fixedly positioned above the base member to an unlocked state wherein the drive spring will cause the mounting rail to move towards the base member, a torque tube connected between the toggle drive subassemblies of the right and left support assemblies, and an actuating mechanism which is manually operable to cause the toggle drive subassemblies of both the right and left subassemblies to become unlocked.

8. An incliner chair which includes a right side member, a left side member, a back member, a seat, a backrest, a legrest, a footrest and a shiftable carriage mechanism mounted between the right and left side members to support the seat, backrest, legrest and footrest and to shift them from a retracted condition wherein the seat is generally horizontally oriented, the backrest is generally vertically oriented, and the legrest and footrest are located beneath the seat (the upright state of the incliner inclined, the backrest is rearwardly inclined and the legrest and footrest are located in front of the seat (reclined state of the incliner chair), the seat and backrest remaining in the same relative position to one another at all times, said shiftable carriage mechanism comprising:

mirror-image right and left support assemblies which each include (1) a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, (2) an extendable foot-rest-legrest subassembly which is connected to said frame subassembly for supporting the footrest and legrest of the incliner chair, said footrest-legrest subassembly including a drive arm, and (3) a toggle drive subassembly which comprises an upper toggle link having a forward end and a rearward end, said upper toggle link being pivotally connected at said forward end to the mounting rail, a lower toggle link which is pivotally connected by a first pivot pin to said base member and by a second pivot pin to said rearward end of said upper toggle link, and a drive spring which extends from said drive arm of the foot-rest-legrest subassembly to said upper toggle link, said upper and lower toggle links being repositionable from a locked state wherein the mounting rail is fixedly positioned above the base member to an unlocked state wherein the drive spring will cause the mounting rail to move towards the base member, a torque tube connected between the toggle drive subassemblies of the right and left support assemblies, and an actuating mechanism which is manually operable to cause the toggle drive subassemblies of both the right and left subassemblies to become unlocked.

* * * * *